US007054807B2

(12) United States Patent
Mittal et al.

(10) Patent No.: US 7,054,807 B2
(45) **Date of Patent: *May 30, 2006**

(54) OPTIMIZING ENCODER FOR EFFICIENTLY DETERMINING ANALYSIS-BY-SYNTHESIS CODEBOOK-RELATED PARAMETERS

(75) Inventors: Udar Mittal, Hoffman Estates, IL (US); James P. Ashley, Naperville, IL (US); Edgardo M. Cruz, Round Lake, IL (US)

(73) Assignee: Motorola, Inc., Schaumburg, IL (US)

( * ) Notice: Subject to any disclaimer, the term of this patent is extended or adjusted under 35 U.S.C. 154(b) by 96 days.

This patent is subject to a terminal disclaimer.

(21) Appl. No.: 10/291,056

(22) Filed: Nov. 8, 2002

(65) Prior Publication Data

US 2004/0093207 A1 May 13, 2004

(51) Int. Cl.
*G10L 19/12* (2006.01)

(52) U.S. Cl. ..... 704/223; 704/220

(58) Field of Classification Search ..... 704/220, 704/222–223, 230

See application file for complete search history.

(56) References Cited

U.S. PATENT DOCUMENTS

| | | | | | |
|---|---|---|---|---|---|
| 4,817,157 | A | * | 3/1989 | Gerson | 704/230 |
| 5,233,660 | A | * | 8/1993 | Chen | 704/222 |
| 5,495,555 | A | * | 2/1996 | Swaminathan | 704/223 |
| 5,598,504 | A | * | 1/1997 | Miyano | 704/222 |
| 5,675,702 | A | * | 10/1997 | Gerson et al. | 704/223 |
| 5,687,284 | A | * | 11/1997 | Serizawa et al. | 704/222 |
| 5,754,976 | A | | 5/1998 | Adoul et al. | |
| 5,774,839 | A | * | 6/1998 | Shlomot | 704/222 |
| 5,787,391 | A | * | 7/1998 | Moriya et al. | 704/220 |
| 5,845,244 | A | * | 12/1998 | Proust | 704/223 |
| 5,924,062 | A | * | 7/1999 | Maung | 704/220 |
| 6,012,024 | A | * | 1/2000 | Hofmann | 704/220 |
| 6,073,092 | A | * | 6/2000 | Kwon | 704/223 |
| 6,104,992 | A | * | 8/2000 | Gao et al. | 704/220 |
| 6,240,386 | B1 | * | 5/2001 | Thyssen et al. | 704/220 |
| 6,470,313 | B1 | * | 10/2002 | Ojala | 704/223 |
| 6,480,822 | B1 | * | 11/2002 | Thyssen | 704/220 |
| 6,493,665 | B1 | * | 12/2002 | Su et al. | 704/220 |
| RE38,279 | E | * | 10/2003 | Kataoka et al. | 704/222 |

* cited by examiner

*Primary Examiner*—Angela Armstrong
(74) *Attorney, Agent, or Firm*—Steven A. May

(57) ABSTRACT

A CELP encoder is provided that optimizes excitation vector-related parameters in a more efficient manner than the encoders of the prior art. In one embodiment, a CELP encoder optimizes excitation vector-related parameters based on a computed correlation matrix, which matrix is in turn based on a filtered first excitation vector. The encoder then evaluates error minimization criteria based on at least in part on a target signal, which target signal is based on an input signal, and the correlation matrix and generates a excitation vector-related index in response to the error minimization criteria. In another embodiment, a CELP encoder is provided that is capable of jointly optimizing and/or sequentially optimizing multiple excitation vector-related parameters by reference to a joint search weighting factor, thereby invoking an optimal error minimization process.

28 Claims, 6 Drawing Sheets

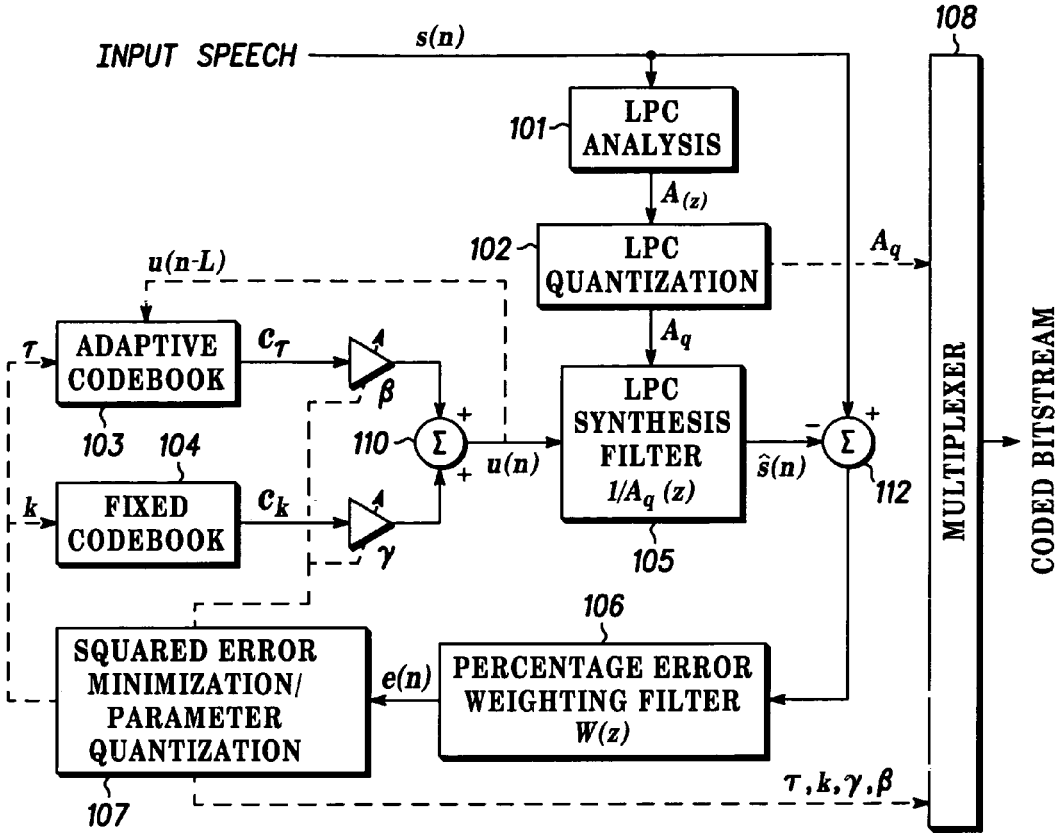
- PRIOR ART - FIG. 1 100
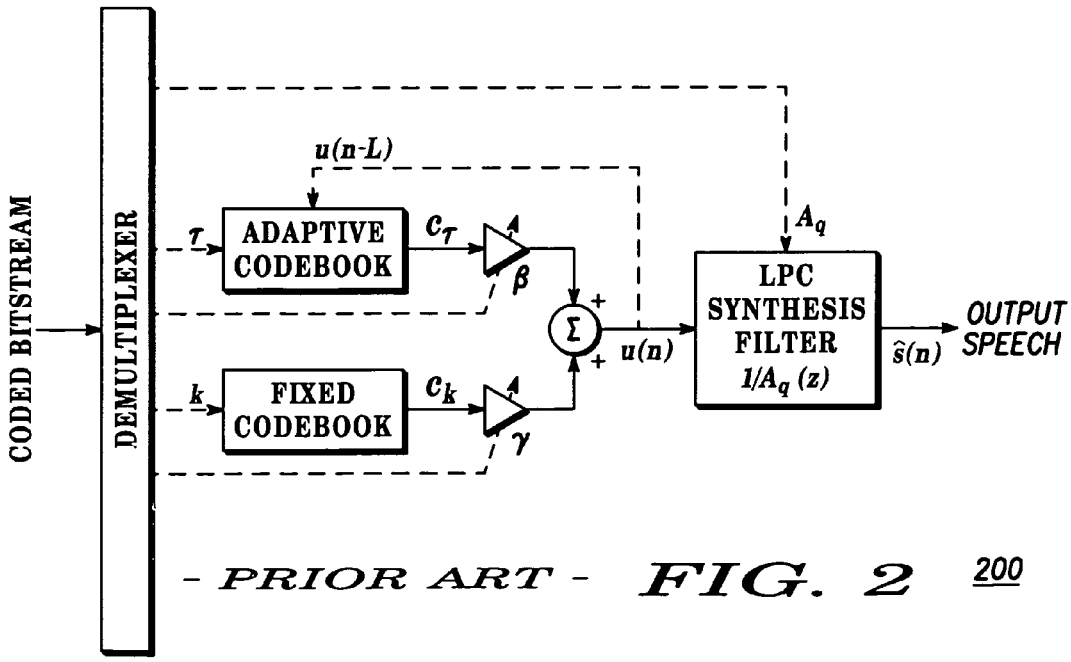
- PRIOR ART - FIG. 2 200

- PRIOR ART -

OPTIMIZING ENCODER FOR EFFICIENTLY DETERMINING ANALYSIS-BY-SYNTHESIS CODEBOOK-RELATED PARAMETERS

CROSS-REFERENCE TO RELATED APPLICATION

This application is related to U.S. patent application Ser. No. 10/290,572, filed on the same date as this application.

FIELD OF THE INVENTION

The present invention relates, in general, to signal compression systems and, more particularly, to Code Excited Linear Prediction (CELP)-type speech coding systems.

BACKGROUND OF THE INVENTION

Compression of digital speech and audio signals is well known. Compression is generally required to efficiently transmit signals over a communications channel, or to store said compressed signals on a digital media device, such as a solid-state memory device or computer hard disk. Although there exist many compression (or "coding") techniques, one method that has remained very popular for digital speech coding is known as Code Excited Linear Prediction (CELP), which is one of a family of "analysis-by-synthesis" coding algorithms. Analysis-by-synthesis generally refers to a coding process by which multiple parameters of a digital model are used to synthesize a set of candidate signals that are compared to an input signal and analyzed for distortion. A set of parameters that yield the lowest distortion is then either transmitted or stored, and eventually used to reconstruct an estimate of the original input signal. CELP is a particular analysis-by-synthesis method that uses one or more codebooks that each essentially comprises sets of code-vectors that are retrieved from the codebook in response to a codebook index.

For example, FIG. 1 is a block diagram of a CELP encoder 100 of the prior art. In CELP encoder 100, an input signal s(n) is applied to a Linear Predictive Coding (LPC) analysis block 101, where linear predictive coding is used to estimate a short-term spectral envelope. The resulting spectral parameters (or LP parameters) are denoted by the transfer function A(z). The spectral parameters are applied to an LPC Quantization block 102 that quantizes the spectral parameters to produce quantized spectral parameters $A_q$ that are suitable for use in a multiplexer 108. The quantized spectral parameters $A_q$ are then conveyed to multiplexer 108, and the multiplexer produces a coded bitstream based on the quantized spectral parameters and a set of codebook-related parameters τ, β, k, and γ, that are determined by a squared error minimization/parameter quantization block 107.

The quantized spectral, or LP, parameters are also conveyed locally to an LPC synthesis filter 105 that has a corresponding transfer function $1/A_q(z)$. LPC synthesis filter 105 also receives a combined excitation signal u(n) from a first combiner 110 and produces an estimate of the input signal ś(n) based on the quantized spectral parameters $A_q$ and the combined excitation signal u(n). Combined excitation signal u(n) is produced as follows. An adaptive codebook code-vector $c_\tau$ is selected from an adaptive codebook (ACB) 103 based on an index parameter τ. The adaptive codebook code-vector $c_\tau$ is then weighted based on a gain parameter β and the weighted adaptive codebook code-vector is conveyed to first combiner 110. A fixed codebook code-vector $c_k$ is selected from a fixed codebook (FCB) 104 based on an index parameter k. The fixed codebook code-vector $c_k$ is then weighted based on a gain parameter γ and is also conveyed to first combiner 110. First combiner 110 then produces combined excitation signal u(n) by combining the weighted version of adaptive codebook code-vector $c_\tau$ with the weighted version of fixed codebook code-vector $c_k$.

LPC synthesis filter 105 conveys the input signal estimate ś(n) to a second combiner 112. Second combiner 112 also receives input signal s(n) and subtracts the estimate of the input signal ś(n) from the input signal s(n). The difference between input signal s(n) and input signal estimate ś(n) is applied to a perceptual error weighting filter 106, which filter produces a perceptually weighted error signal e(n) based on the difference between ś(n) and s(n) and a weighting function W(z). Perceptually weighted error signal e(n) is then conveyed to squared error minimization/parameter quantization block 107. Squared error minimization/parameter quantization block 107 uses the error signal e(n) to determine an optimal set of codebook-related parameters τ, β, k, and γ that produce the best estimate ś(n) of the input signal s(n).

FIG. 2 is a block diagram of a decoder 200 of the prior art that corresponds to encoder 100. As one of ordinary skilled in the art realizes, the coded bitstream produced by encoder 100 is used by a demultiplexer in decoder 200 to decode the optimal set of codebook-related parameters, that is, τ, β, k, and γ, in a process that is identical to the synthesis process performed by encoder 100. Thus, if the coded bitstream produced by encoder 100 is received by decoder 200 without errors, the speech ś(n) output by decoder 200 can be reconstructed as an exact duplicate of the input speech estimate ś(n) produced by encoder 100.

While CELP encoder 100 is conceptually useful, it is not a practical implementation of an encoder where it is desirable to keep computational complexity as low as possible. As a result, FIG. 3 is a block diagram of an exemplary encoder 300 of the prior art that utilizes an equivalent, and yet more practical, system to the encoding system illustrated by encoder 100. To better understand the relationship between encoder 100 and encoder 300, it is beneficial to look at the mathematical derivation of encoder 300 from encoder 100. For convenience of the reader, the variables are given in terms of their z-transforms.

From FIG. 1, it can be seen that perceptual error weighting filter 106 produces the weighted error signal e(n) based on a difference between the input signal and the estimated input signal, that is:

$$E(z)=W(z)(S(z)-\acute{S}(z)). \tag{1}$$

From this expression, the weighting function W(z) can be distributed and the input signal estimate ś(n) can be decomposed into the filtered sum of the weighted codebook code-vectors:

$$E(z) = W(z)S(z) - \frac{W(z)}{A_q(z)}(\beta C_\tau(z) + \gamma C_k(z)). \tag{2}$$

The term W(z)S(z) corresponds to a weighted version of the input signal. By letting the weighted input signal W(z)S(z) be defined as $S_w(z)=W(z)S(z)$ and by further letting weighted synthesis filter 105 of encoder 100 now be defined by a transfer function $H(z)=W(z)/A_q(z)$, Equation 2 can rewritten as follows:

$$E(z)=S_w(z)-H(z)(\beta C_\tau(z)+\gamma C_k(z)). \quad (3)$$

By using z-transform notation, filter states need not be explicitly defined. Now proceeding using vector notation, where the vector length L is a length of a current subframe, Equation 3 can be rewritten as follows by using the superposition principle:

$$e=s_w-H(\beta c_\tau+\gamma c_k)-h_{zir}, \quad (4)$$

where:

H is the L×L zero-state weighted synthesis convolution matrix formed from an impulse response of a weighted synthesis filter h(n), such as synthesis filters 303 and 304, and corresponding to a transfer function $H_{zs}(z)$ or H(z), which matrix can be represented as:

$$H=\begin{bmatrix} h(0) & 0 & \cdots & 0 \\ h(1) & h(0) & \cdots & 0 \\ \vdots & \vdots & \ddots & \vdots \\ h(L-1) & h(L-2) & \cdots & h(0) \end{bmatrix}, \quad (5)$$

$h_{zir}$ is a L×1 zero-input response of H(z) that is due to a state from a previous input, $s_w$ is the L×1 perceptually weighted input signal, β is the scalar adaptive codebook (ACB) gain, $c_\tau$ is the L×1 ACB code-vector in response to index τ, γ is the scalar fixed codebook (FCB) gain, and $C_k$ the L×1 FCB code-vector in response to index k.

By distributing H, and letting the input target vector $x_w=s_w-h_{zir}$, the following expression can be obtained:

$$e=x_w-\beta Hc_\tau-\gamma Hc_k. \quad (6)$$

Equation 6 represents the perceptually weighted error (or distortion) vector e(n) produced by a third combiner 307 of encoder 300 and coupled by combiner 307 to a squared error minimization/parameter block 308.

From the expression above, a formula can be derived for minimization of a weighted version of the perceptually weighted error, that is, $\|e\|^2$, by squared error minimization/parameter block 308. A norm of the squared error is given as:

$$\epsilon=\|e\|^2=\|x_w-\beta Hc_\tau-\gamma Hc_k\|^2. \quad (7)$$

Due to complexity limitations, practical implementations of speech coding systems typically minimize the squared error in a sequential fashion. That is, the ACB component is optimized first (by assuming the FCB contribution is zero), and then the FCB component is optimized using the given (previously optimized) ACB component. The ACB/FCB gains, that is, codebook-related parameters β and γ, may or may not be re-optimized, that is, quantized, given the sequentially selected ACB/FCB code-vectors $c_\tau$ and $c_k$.

The theory for performing the sequential search is as follows. First, the norm of the squared error as provided in Equation 7 is modified by setting γ=0, and then expanded to produce:

$$\epsilon=\|x_w-\beta Hc_\tau\|^2=x_w^Tx_w-2\beta x_w^THc_\tau+\beta^2c_\tau^TH^THc_\tau. \quad (8)$$

Minimization of the squared error is then determined by taking the partial derivative of ε with respect to β and setting the quantity to zero:

$$\frac{\partial\varepsilon}{\partial\beta}=x_w^THc_\tau-\beta c_\tau^TH^THc_\tau=0. \quad (9)$$

This yields an (sequentially) optimal ACB gain:

$$\beta=\frac{x_w^THc_\tau}{c_\tau^TH^THc_\tau}. \quad (10)$$

Substituting the optimal ACB gain back into Equation 8 gives:

$$\tau^*=\underset{\tau}{\operatorname{argmin}}\left\{x_w^Tx_w-\frac{(x_w^THc_\tau)^2}{c_\tau^TH^THc_\tau}\right\}, \quad (11)$$

where τ* is a sequentially determined optimal ACB index parameter, that is, an ACB index parameter that minimizes the bracketed expression. Since $x_w$ is not dependent on τ, Equation 11 can be rewritten as follows:

$$\tau^*=\underset{\tau}{\operatorname{argmax}}\left\{\frac{(x_w^THc_\tau)^2}{c_\tau^TH^THc_\tau}\right\}. \quad (12)$$

Now, by letting $y_\tau$ equal the ACB code-vector $c_\tau$ filtered by weighted synthesis filter 303, that is, $y_\tau=Hc_\tau$, Equation 13 can be simplified to:

$$\tau^*=\underset{\tau}{\operatorname{argmax}}\left\{\frac{(x_w^Ty_\tau)^2}{y_\tau^Ty_\tau}\right\}, \quad (13)$$

and likewise, Equation 10 can be simplified to:

$$\beta=\frac{x_w^Ty_\tau}{y_\tau^Ty_\tau}. \quad (14)$$

Thus Equations 13 and 14 represent the two expressions necessary to determine the optimal ACB index τ and ACB gain β in a sequential manner. These expressions can now be used to determine the sequentially optimal FCB index and gain expressions. First, from FIG. 3, it can be seen that a second combiner 306 produces a vector $x_2$, where $x_2=x_w-\beta Hc_\tau$. The vector $x_w$ is produced by a first combiner 305 that subtracts a past excitation signal u(n-L), after filtering by a weighted synthesis filter 301, from an output $s_w(n)$ of a perceptual error weighting filter 302. The term $\beta Hc_\tau$ is a filtered and weighted version of ACB code-vector $c_\tau$, that is, ACB code-vector $c_\tau$ filtered by weighted synthesis filter 303 and then weighted based on ACB gain parameter β. Substituting the expression $X_2=x_w-\beta Hc_\tau$ into Equation 7 yields:

$$\epsilon=\|x_2-\gamma Hc_k\|^2. \quad (15)$$

where $\gamma Hc_k$ is a filtered and weighted version of FCB code-vector $c_k$, that is, FCB code-vector $c_k$ filtered by weighted synthesis filter 304 and then weighted based on FCB gain parameter $\gamma$. Similar to the above derivation of the optimal ACB index parameter $\tau^*$, it is apparent that:

$$k^* = \underset{\tau}{\operatorname{argmax}}\left\{\frac{(x_2^T H c_k)^2}{c_k^T H^T H c_k}\right\}, \tag{16}$$

where k* is a sequentially optimal FCB index parameter, that is, an FCB index parameter that maximizes the bracketed expression. By grouping terms that are not dependent on k, that is, by letting $d_2^T = x_2^T H$ and $\Phi = H^T H$, Equation 16 can be simplified to:

$$k^* = \underset{\tau}{\operatorname{argmax}}\left\{\frac{(d_2^T c_k)^2}{c_k^T \Phi c_k}\right\}, \tag{17}$$

in which the sequentially optimal FCB gain $\gamma$ is given as:

$$\gamma = \frac{d_2^T c_k}{c_k^T \Phi c_k}. \tag{18}$$

Thus, encoder 300 provides a method and apparatus for determining the optimal excitation vector-related parameters $\tau$, $\beta$, k, and $\gamma$, in a sequential manner. However, the sequential determination of parameters $\tau$, $\beta$, k, and $\gamma$ is actually sub-optimal since the optimization equations do not consider the effects that the selection of one codebook code-vector has on the selection of the other codebook code-vector.

In order to better optimize the codebook-related parameters $\tau$, $\beta$, k, and $\gamma$, a paper entitled "Improvements to the Analysis-by Synthesis Loop in CELP Codecs," by Woodward, J. P. and Hanzo, L., published by the IEEE Conference on Radio Receivers and Associated Systems, dated Sep. 26–28, 1995, pages 114–118 (hereinafter referred to as the "Woodward and Hanzo paper"), discusses several joint search procedures. One discussed joint search procedure involves an exhaustive search of both the ACB and the FCB. However, as noted in the paper, such a joint search process involves nearly 60 times the complexity of a sequential search process. Other joint search processes discussed in the paper that yield a result nearly as good as the exhaustive search of both the ACB and the FCB involve complexity increases of 30 to 40 percent over the sequential search process. However, even a 30 to 40 percent increase in complexity can present an undesirable load to a processor when the processor is being asked to run ever increasing numbers of applications, placing processor load at a premium.

Therefore, there exists a need for a method and apparatus for determine the analysis-by-synthesis codebook-related parameters $\tau$, $\beta$, k, and $\gamma$, in a more efficient manner, which method an apparatus do not involve the complexity of the joint search processes of the prior art.

BRIEF DESCRIPTION OF THE DRAWINGS

FIG. 1 is a block diagram of a Code Excited Linear Prediction (CELP) encoder of the prior art.

FIG. 2 is a block diagram of a CELP decoder of the prior art.

DETAILED DESCRIPTION OF THE INVENTION

Figure 3:
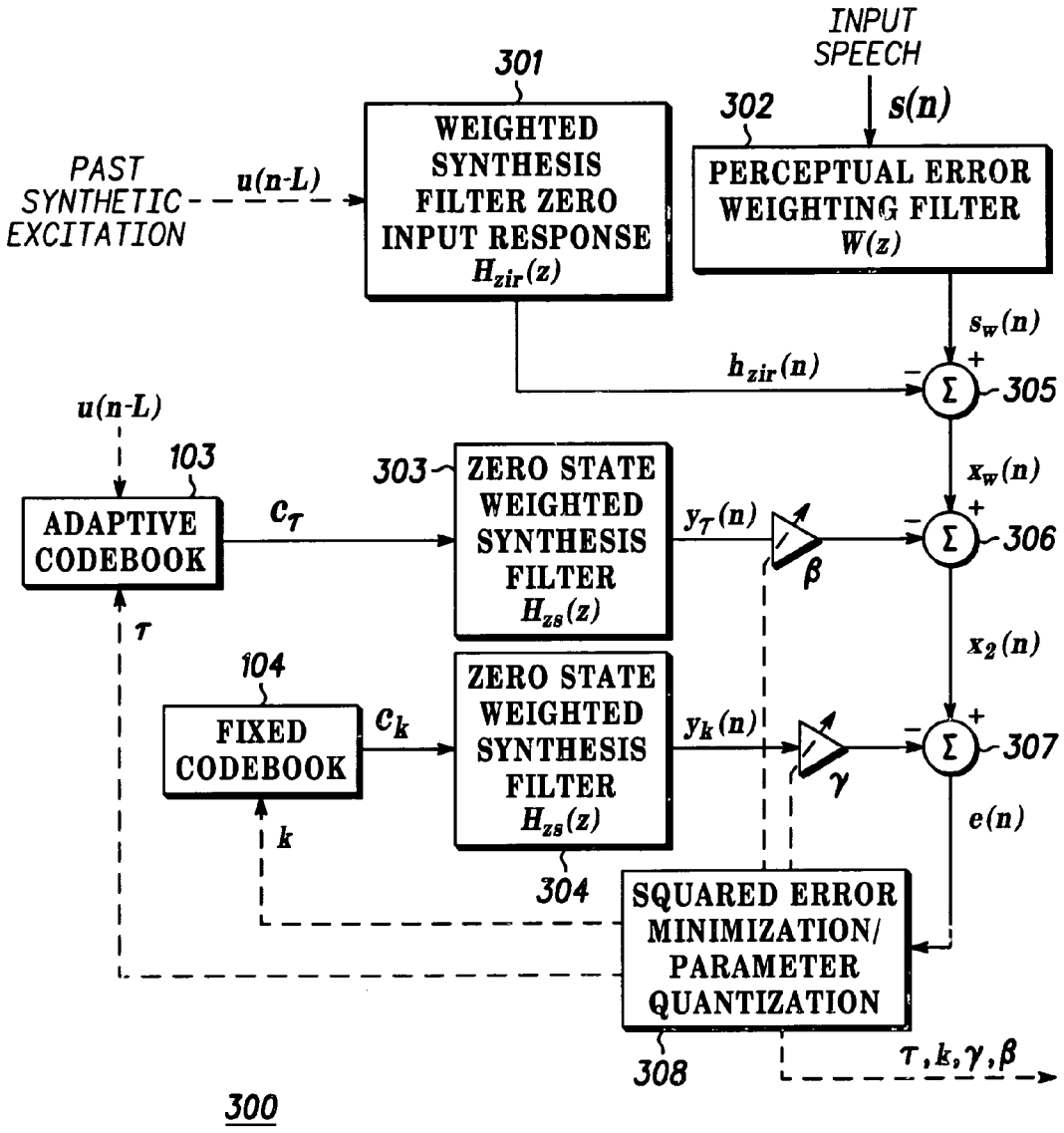
FIG. 3 is a block diagram of another CELP encoder of the prior art.

To address the need for a method and an apparatus for determining analysis-by-synthesis codebook-related parameters $\tau$, $\beta$, k, and $\gamma$, in a more efficient manner, which method an apparatus do not involve the complexity of the joint search processes of the prior art, a CELP encoder is provided that optimizes codebook parameters in a more efficient manner than the encoders of the prior art. In one embodiment of the present invention, a CELP encoder optimizes excitation vector-related indices based on a computed correlation matrix, which matrix is in turn based on a filtered first excitation vector. The encoder then evaluates error minimization criteria based on at least in part on a target signal, which target signal is based on an input signal, and the correlation matrix and generates a excitation vector-related index parameter in response to the error minimization criteria. In another embodiment of the present invention, the encoder also backward filters the target signal to produce a backward filtered target signal and evaluates the error minimization criteria based on at least in part on the backward filtered target signal and the correlation matrix. In still another embodiment of the present invention, an CELP encoder is provided that is capable of jointly optimizing and/or sequentially optimizing multiple excitation vector-related parameters by reference to a joint search weighting factor, thereby invoking an optimal error minimization process.

Generally, one embodiment of the present invention encompasses a method for analysis-by-synthesis coding of a signal. The method includes steps of generating a target signal based on an input signal, generating a first excitation vector, and generating one or more elements of a correlation matrix based in part on the first excitation vector. The method further includes steps of evaluating an error minimization criteria based in part on the target signal and the one or more elements of the correlation matrix and generating a parameter associated with a second excitation vector based on the error minimization criteria.

Another embodiment of the present invention encompasses a method for analysis-by-synthesis coding of a subframe. The method includes steps of calculating a joint search weighting factor and, based on the calculated joint search weighting factor, performing an optimization process that is a hybrid of a joint optimization of at least two excitation vector-related parameters of multiple excitation vector-related parameters and a sequential optimization of the at least two excitation vector-related parameters of the multiple excitation vector-related parameters.

Still another embodiment of the present invention encompasses an analysis-by-synthesis coding apparatus. The apparatus includes means for generating a target signal based on an input signal, a vector generator that generates a first excitation vector, and an error minimization unit that generates one or more elements of a correlation matrix based in part on the first excitation vector, evaluates error minimization criteria based at least in part on the one or more elements of the correlation matrix and the target signal, and generates a parameter associated with a second excitation vector based on the error minimization criteria.

Yet another embodiment of the present invention encompasses an encoder for analysis-by-synthesis coding of a subframe. The encoder includes a processor that calculates a joint search weighting factor and based on the joint search weighting factor, performs an optimization process that is a hybrid of a joint optimization of at least two parameters of multiple excitation vector-related parameters and a sequential optimization of the at least two parameters of the multiple excitation vector-related parameters.

Figure 4:
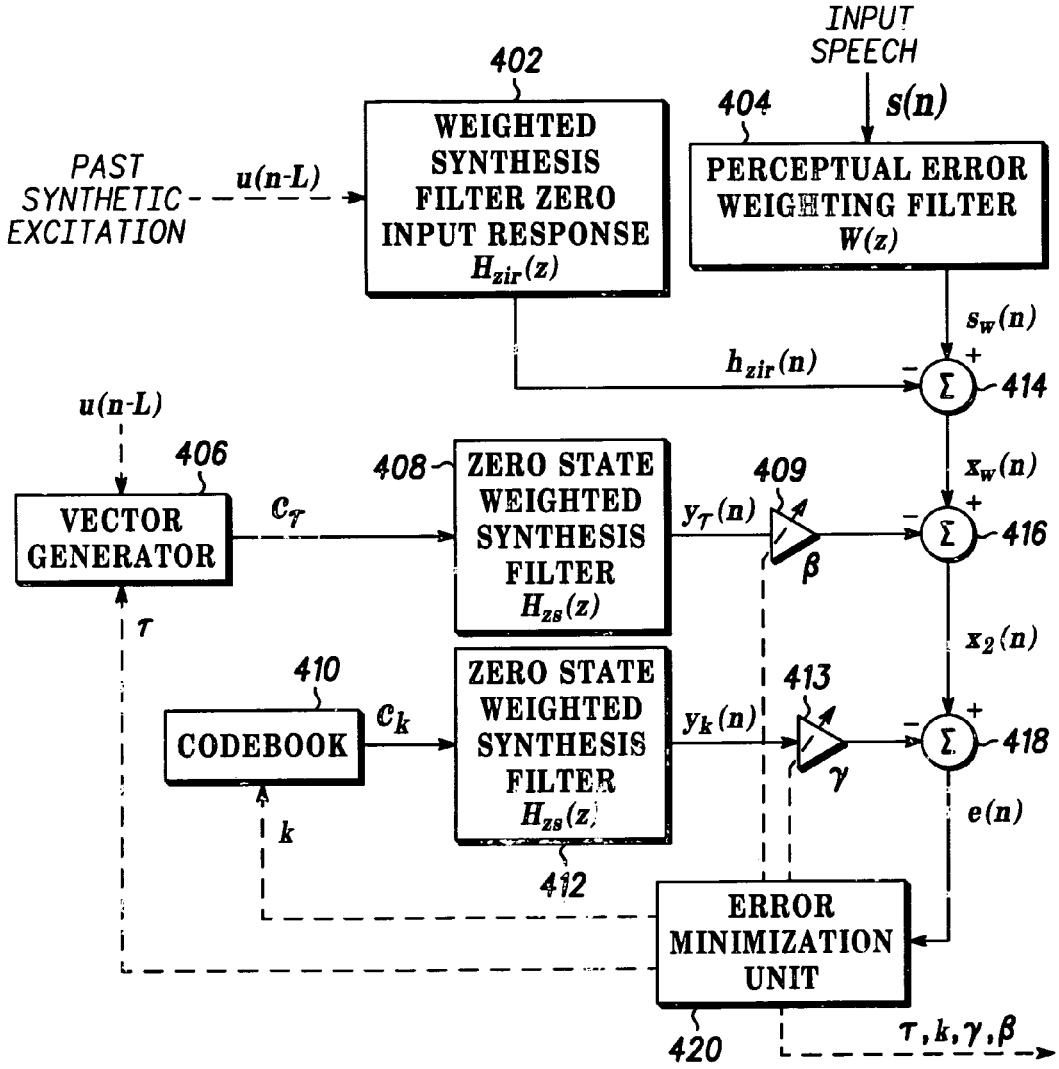
FIG. 4 is a block diagram of a CELP encoder in accordance with an embodiment of the present invention.

The present invention may be more fully described with reference to FIGS. 4–7. FIG. 4 is a block diagram of a Code Excited Linear Prediction (CELP) encoder 400 that implements an analysis-by-synthesis coding process in accordance with an embodiment of the present invention. Encoder 400 is implemented in a processor, such as one or more microprocessors, microcontrollers, digital signal processors (DSPs), combinations thereof or such other devices known to those having ordinary skill in the art, that is in communication with one or more associated memory devices, such as random access memory (RAM), dynamic random access memory (DRAM), and/or read only memory (ROM) or equivalents thereof, that store data and programs that may be executed by the processor.

Figure 5A:
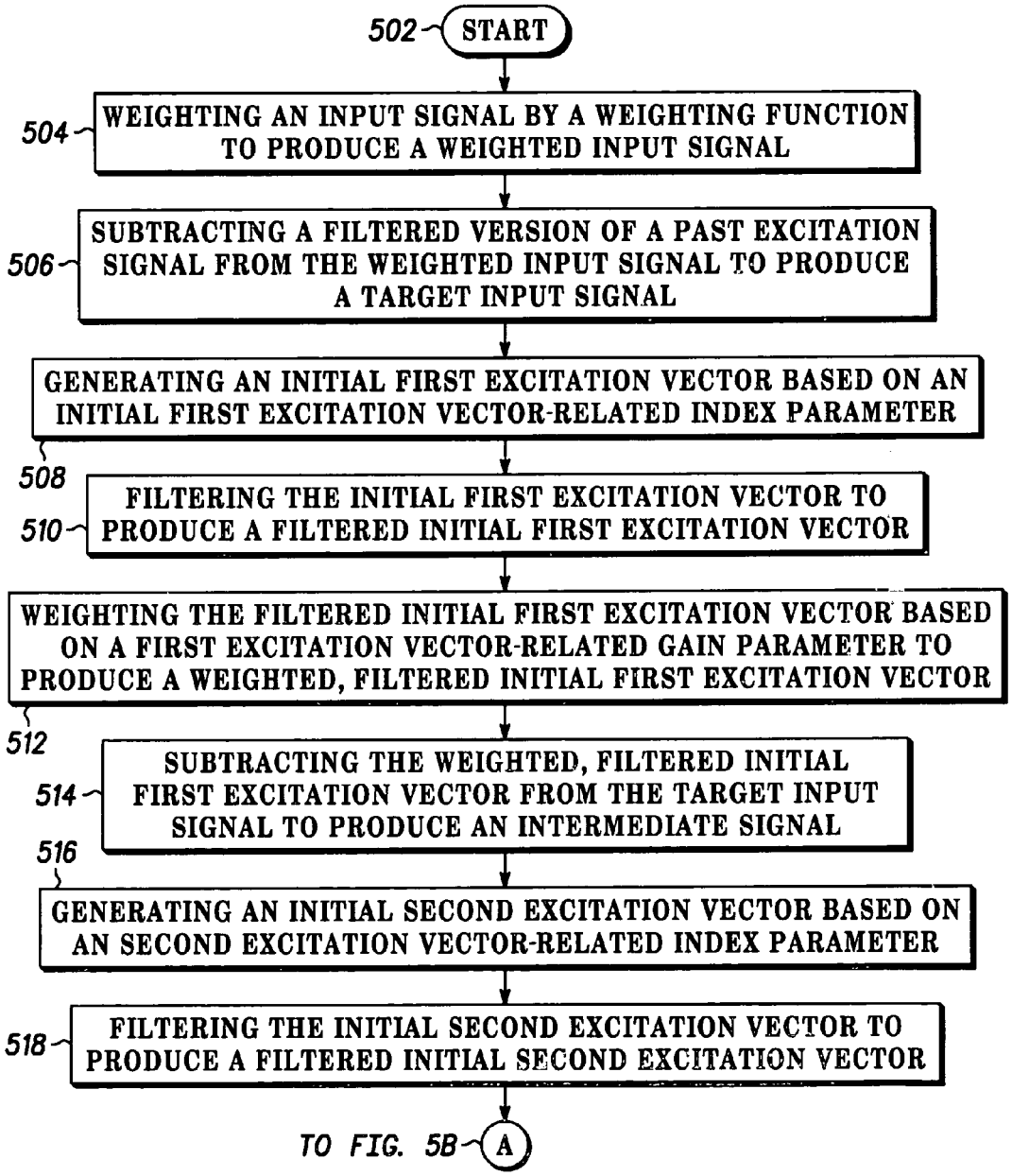
FIG. 5 is a logic flow diagram of steps executed by the CELP encoder of FIG. 4 in coding a signal in accordance with an embodiment of the present invention.
Figure 5B:
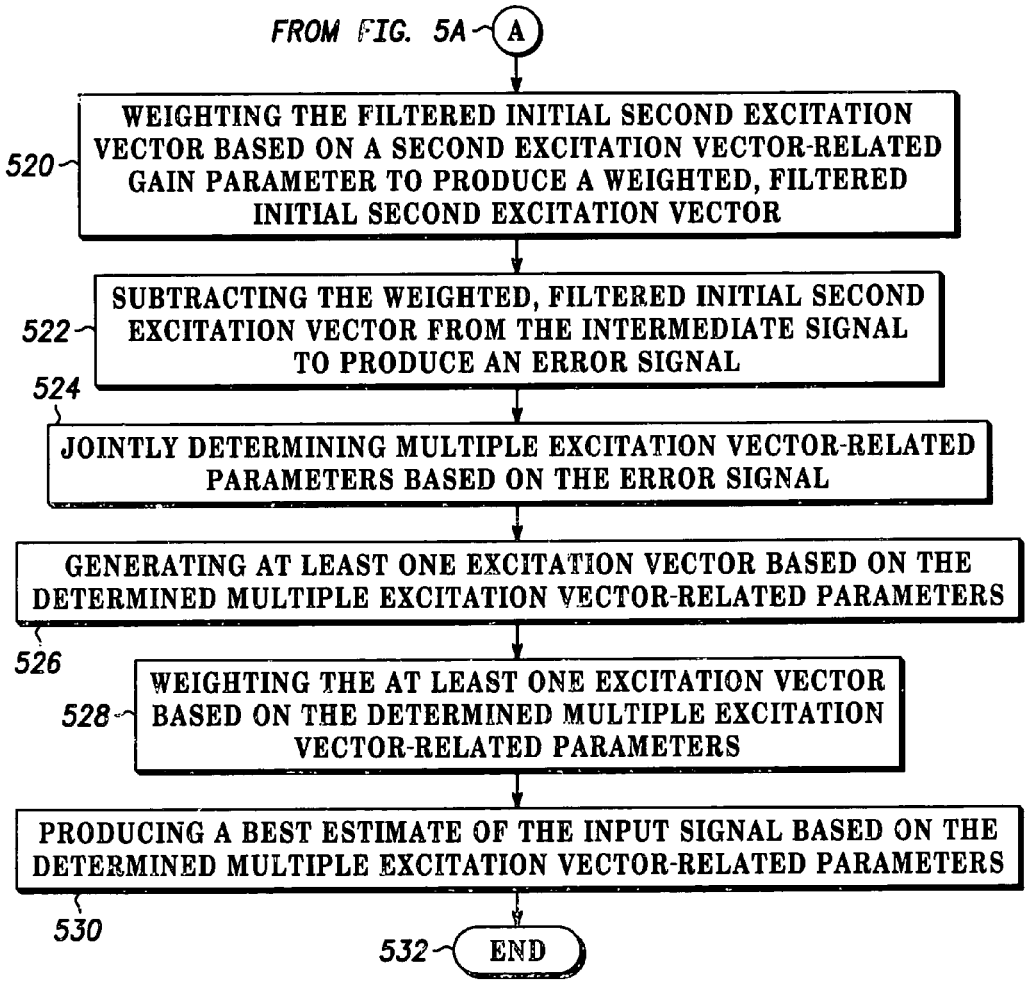

FIG. 5 is a logic flow diagram 500 of the steps executed by encoder 400 in coding a signal in accordance with an embodiment of the present invention. Logic flow 500 begins (502) when an input signal s(n) is applied to a perceptual error weighting filter 404. Weighting filter 404 weights (504) the input signal by a weighting function W(z) to produce a weighted input signal $s_w(n)$, which weighted input signal can be represented in vector notation as a vector $s_w$. In addition, a past excitation signal u(n-L) is applied to a weighted synthesis filter 402 with a corresponding zero input response of $H_{zir}(z)$. Weighted input signal $s_w(n)$ and a filtered version of past excitation signal u(n-L) produced by weighted synthesis filter 402 are each conveyed to a first combiner 414. First combiner 414 subtracts (506) the filtered version of past excitation signal u(n-L) from the weighted input signal $s_w(n)$ to produce a target input signal $x_w(n)$. In vector notation, the target input signal $x_w(n)$ may be represented as a vector $x_w$, where $x_w=s_w-h_{zir}$ and $h_{zir}$ corresponds to the past excitation signal u(n-L) as filtered by weighted synthesis filter 402. First combiner 414 then conveys target input signal $x_w(n)$, or vector $x_w$, to a second combiner 416.

An initial first excitation vector $c_\tau$ is generated (508) by a vector generator 406 based on an excitation vector-related parameter τ sourced to the vector generator by an error minimization unit 420. In one embodiment of the present invention, vector generator 406 is a virtual codebook such as an adaptive codebook that stores multiple vectors and parameter τ is an index parameter that corresponds to a vector of the multiple vectors stored in the codebook. In such an embodiment, $c_\tau$ is an adaptive codebook (ACB) code-vector. In another embodiment of the present invention, vector generator 406 is a long-term predictor (LTP) filter and parameter τ is an lag corresponding to a selection of a past excitation signal u(n-L).

The initial first excitation vector $c_\tau$ is conveyed to a first zero state weighted synthesis filter 408 that has a corresponding transfer function $H_{zs}(z)$, or in matrix notation H. Weighted synthesis filter 408 filters (510) the initial first excitation vector $c_\tau$ to produce a signal $y_\tau(n)$ or, in vector notation, a vector $y_\tau$, wherein $y_\tau=Hc_\tau$. The filtered initial first excitation vector $y_\tau(n)$, or $y_\tau$, is then weighted (512) by a first weighter 409 based on an initial first excitation vector-related gain parameter β and the weighted, filtered initial first excitation vector $\beta y_\tau$, or $\beta Hc_\tau$, is conveyed to second combiner 416.

Second combiner 416 subtracts (514) the weighted, filtered initial first excitation vector $\beta y_\tau$, or $\beta Hc_\tau$, from the target input signal or vector $x_w$ to produce an intermediate signal $x_2(n)$, or in vector notation an intermediate vector $x_2$, wherein $x_2=x_w-\beta Hc_\tau$. Second combiner 416 then conveys intermediate signal $x_2(n)$, or vector $x_2$, to a third combiner 418. Third combiner 418 also receives a weighted, filtered version of an initial second excitation vector $c_k$, preferably a fixed codebook (FCB) code-vector. The initial second excitation vector $c_k$ is generated (516) by a codebook 410, preferably a fixed codebook (FCB), based on an initial second excitation vector-related index parameter k, preferably an FCB index parameter. The initial second excitation vector $c_k$ is conveyed to a second zero state weighted synthesis filter 412 that also has a corresponding transfer function $H_{zs}(z)$, or in matrix notation H. Weighted synthesis filter 412 filters (518) the initial second excitation vector $c_k$ to produce a signal $y_k(n)$, or in vector notation a vector $y_k$, where $y_k=Hc_k$. The filtered initial second excitation vector $y_k(n)$, or $y_k$, is then weighted (520) by a second weighter 413 based on an initial second excitation vector-related gain parameter γ. The weighted, filtered initial second excitation vector $\gamma y_k$, or $\gamma Hc_k$, is then also conveyed to third combiner 418.

Similar to encoder 300, the symbols used herein are defined as follows:

H is the L×L zero-state weighted synthesis convolution matrix formed from an impulse response of a weighted synthesis filter h(n), such as synthesis filters 303 and 304, and corresponding to a transfer function $H_{zs}(z)$ or H(z), which matrix can be represented as:

$$H=\begin{bmatrix} h(0) & 0 & \cdots & 0 \\ h(1) & h(0) & \cdots & 0 \\ \vdots & \vdots & \ddots & \vdots \\ h(L-1) & h(L-2) & \cdots & h(0) \end{bmatrix}, \tag{5}$$

$h_{zir}$ is a L×1 zero-input response of H(z) that is due to a state from a previous input, $s_w$ is the L×1 perceptually weighted input signal, β is the scalar first excitation vector-related gain, $c_\tau$ is the L×1 first excitation vector generated in response to parameter τ, γ is the scalar second excitation vector-related gain, and $c_k$ is the L×1 second excitation vector generated in response to index parameter k.

Although vector generator 406 is described herein as a virtual codebook or an LTP filter and codebook 410 is described herein as a fixed codebook, those who are of ordinary skill in the art realize that the arrangement of the codebooks and their respective code-vectors may be varied without departing from the spirit and scope of the present invention. For example, the first codebook may be a fixed codebook, the second codebook may be an adaptive codebook, or both the first and second codebooks may be fixed codebooks.

Third combiner 418 subtracts (522) the weighted, filtered initial second excitation vector $\gamma y_k$ or $\gamma Hc_k$, from the intermediate signal $x_2(n)$, or intermediate vector $x_2$, to produce a perceptually weighted error signal e(n). Perceptually weighted error signal e(n) is then conveyed to error minimization unit 420, preferably a squared error minimization/parameter quantization block. Error minimization unit 420 uses the error signal e(n) to jointly determine (524) at least three of multiple excitation vector-related parameters τ, β, k, and γ that optimize the performance of encoder 400 by minimizing a squared sum of the error signal e(n). Optimization of index parameters τ and k, that is, a determination of τ* and k*, respectively results in a generation (526) of an optimal first excitation vector $c_\tau$* by vector generator 406 and an optimal second excitation vector $c_k$* by codebook 410, and optimization of parameters β and γ respectively results in optimal weightings (528) of the filtered versions of the optimal excitation vectors $c_\tau$* and $c_k$*, thereby producing (530) a best estimate of the input signal s(n). The logic flow then ends (532).

Unlike squared error minimization/parameter block 308 of encoder 300, which determines an optimal set of multiple codebook-related parameters τ, β, k, and γ by performing a sequential optimization process, error minimization unit 420 of encoder 400 determines the optimal set of excitation vector-related parameters τ, β, k, and γ by performing a joint optimization process at step (524). By performing a joint optimization process, a determination of excitation vector-related parameters τ, β, k, and γ is optimized since the effects that the selection of one excitation vector has on the selection of the other excitation vector is taken into consideration in the optimization of each parameter.

In vector notation, error signal e(n) can be represented by a vector e, where $e=x_w-\beta Hc_\tau-\gamma Hc_k$. This expression represents the perceptually weighted error (or distortion) signal e(n), or error vector e, produced by third combiner 418 of encoder 400 and coupled by combiner 418 to error minimization unit 420. The joint optimization process performed by error minimization unit 420 of encoder 400 at step (524) seeks to minimize a weighted version of the perceptually weighted squared error, that is, $\|e\|^2$, and can be derived as follows.

Based on error vector e produced by third combiner 418, a total squared error, or a joint error, ε, where $\epsilon=\|e\|^2$, can be defined as follows:

$$\epsilon=\|x_w-\beta Hc_\tau-\gamma Hc_k\|^2. \tag{19}$$

An expansion of equation 19 produces the following equation:

$$\epsilon=x_w^Tx_w-2\beta x_x^THc_\tau-2\gamma x_w^THc_k+\beta^2c_\tau^TH^THc_\tau+2\beta\gamma c_\tau^TH^THc_k+\gamma^2c_k^TH^THc_k. \tag{20}$$

The 'vector generator 406/codebook 410,' or 'first codebook/second codebook,' cross term $\beta\gamma c_\tau^TH^THc_k$ present in Equation 20 is not present in the sequential optimization process performed by encoder 300 of the prior art. The presence of the cross term in the joint optimization analysis performed by encoder 400, and the absence of the term from the process performed by encoder 300, has a profound effect on the selection of the respective optimal excitation vector indices τ* and k* and corresponding excitation vectors $C_\tau$* and $c_k$*. Taking partial derivatives of the above error expression, that is, Equation 20, and setting the partial derivatives to zero, yields the following set of simultaneous equations, which can be used to derive an appropriate error minimization criteria:

$$\frac{\partial\varepsilon}{\partial\beta}=x_w^THc_\tau-\beta c_\tau^TH^THc_\tau-\gamma c_\tau^TH^THc_k=0, \tag{21}$$

$$\frac{\partial\varepsilon}{\partial\gamma}=x_w^THc_k-\beta c_\tau^TH^THc_k-\gamma c_k^TH^THc_k=0. \tag{22}$$

Rewriting Equations 21 and 22 in vector-matrix form yields the following equation:

$$x_w^TH[c_\tau\ \ c_k]=\begin{bmatrix} c_\tau^TH^THc_\tau & c_k^TH^THc_\tau \\ c_\tau^TH^THc_k & c_k^TH^THc_k \end{bmatrix}\begin{bmatrix}\beta\\ \gamma\end{bmatrix}. \tag{23}$$

Equation 23 can be simplified by combining terms not dependent on τ or k, that is, by letting $d^T=x_w^TH$ and $\Phi=H^TH$, to produce the following equation:

$$d^T[c_\tau\ \ c_k]=\begin{bmatrix} c_\tau^T\Phi c_\tau & c_k^T\Phi c_\tau \\ c_\tau^T\Phi c_k & c_k^T\Phi c_k \end{bmatrix}\begin{bmatrix}\beta\\ \gamma\end{bmatrix}, \tag{24}$$

or equivalently:

$$d^T[c_\tau\ \ c_k]=\begin{bmatrix} c_\tau^T \\ c_\tau^T \end{bmatrix}\Phi[c_\tau\ \ c_k]\begin{bmatrix}\beta\\ \gamma\end{bmatrix}. \tag{25}$$

By letting C equal the code-vector set $[c_\tau\ c_k]$, that is, $C=[c_\tau\ c_k]$, and solving for [β γ], error minimization unit 420 can jointly determine optimal first and second codebook gains based on the following equation:

$$[\beta\ \gamma]=d^TC[C^T\Phi C]^{-1}. \tag{26}$$

Equation 26 is markedly similar to the optimal gain expressions, that is, Equations 10 and 18, for the sequential case except that C comprises a length L×2 matrix, rather than a L×1 vector. Now referring back to the joint error expression, that is, Equation 20, and rewriting Equation 20 in terms of $d^T$ and Φ produces the equation:

$$\epsilon=x_w^Tx_w-2\beta d^Tc_\tau-2\gamma d^Tc_k+\beta^2c_\tau^T\Phi c_\tau+2\beta\gamma c_\tau^T\Phi c_k+\gamma^2c_k^T\Phi c_k, \tag{27}$$

or equivalently:

$$\varepsilon=x_w^Tx_w=2d^T[c_\tau\ \ c_k]\begin{bmatrix}\beta\\ \gamma\end{bmatrix}+[\beta\ \ \gamma]\begin{bmatrix} c_\tau^T \\ c_\tau^T \end{bmatrix}\Phi[c_\tau\ \ c_k]\begin{bmatrix}\beta\\ \gamma\end{bmatrix}. \tag{28}$$

Substituting the excitation vector set $C=[C_\tau\ c_k]$ and the jointly optimal excitation vector-related gains $[\beta\ \gamma]=d^TC[C^T\Phi C]^{-1}$ into Equation 28 produces the following equation:

$$\epsilon=x_w^Tx_w-2d^TC([C^T\Phi C]^{-1}C^Td)+(d^TC[C^T\Phi C]^{-1})C^T\Phi C([C^T\Phi C]^{-1}C^Td). \tag{29}$$

Since $C^T\Phi C[C^T\Phi C]^{-1}=I$, Equation 29 can be reduced to:

$$\epsilon=x_w^Tx_w-d^TC[C^T\Phi C]^{-1}C^Td. \tag{30}$$

Based on equation 30, an equation by which error minimization unit 420 of encoder 400 can jointly determine the optimal first and second excitation vector-related indices $\tau^*$ and $k^*$ can now be expressed as:

$$[\tau^* \quad k^*] = \underset{\tau,k}{\arg\max}\{d^T C[C^T \Phi C]^{-1} C^T d\}, \tag{31}$$

which equation is notably similar to Equations 13 and 17 and wherein the right-hand side of the equation comprises error minimization criteria evaluated by the error minimization unit. Equation 31 represents a simultaneous, joint optimization of both of the first and second excitation vectors $c_\tau^*$ and $c_k^*$, and their associated gains based on a minimum weighted squared error.

However, implementation of this joint optimization is a complex matter. In order to provide a simplified, more easily implemented alternative, in another embodiment of the present invention a first excitation vector $c_\tau$ may be optimized in advance by error minimization unit 420, preferably via Equation 14, and the remaining parameters $c_k$, $\beta$, and $\gamma$ may then be determined by the error minimization unit in a jointly optimal fashion. In deriving a simplified expression that may be executed by error minimization unit 420 in such an embodiment, the error minimization criteria of Equation 31, that is, the right-hand side of Equation 31, may be rewritten as follows by expanding the equation and eliminating terms that are independent of $c_k$:

$$k^* = \underset{k}{\operatorname{argmax}}\left\{d^T [c_\tau \quad c_k] \begin{bmatrix} c_\tau^T \Phi c_\tau & c_k^T \Phi c_\tau \\ c_\tau^T \Phi c_k & c_k^T \Phi c_k \end{bmatrix}^{-1} [c_\tau \quad c_k]^T d\right\}. \tag{32}$$

Inverting the inner matrix and substituting temporary variables yields the following equation for optimization of the second excitation vector-related index parameter k:

$$k^* = \underset{k}{\operatorname{argmax}}\left\{\frac{1}{D_k}(MA_k^2 - 2NA_k B_k + R_k N^2)\right\} \tag{33}$$

where $M=c_\tau^T \Phi c_\tau$, $N=d^T c_\tau$, $B_k=c_\tau^T \Phi c_k$, $A_k=d^T c_k$, $R_k=c_k^T \Phi c_k$ and the determinant of the inverted matrix in Equation 32, that is, $D_k$, is described by the following equation, $D_k=c_\tau^T \Phi c_\tau c_k^T \Phi c_k - c_k^T \Phi c_\tau c_\tau^T \Phi c_k = MR_k - B_k^2$. It may be noted that M is an energy of the filtered first excitation vector, N is a correlation between weighted speech and the filtered first excitation vector, $A_k$ is a correlation between a reverse filtered target vector and the second excitation vector, and $B_k$ is a correlation between the filtered first excitation vector and the second filtered excitation vector.

Typically, a drawback of a joint search optimization process as compared to a sequential search optimization process is the relative complexity of the joint search optimization process due to the extra operations required to compute the numerator and denominator of a joint search optimization equation. However, a complexity of the second excitation vector-related index optimization equation resulting from the joint search process, that is, Equation 33, can be made approximately equal to a complexity of the second codebook index optimization equation resulting from the sequential search performed by encoder 300 by transforming the parameters of Equation 33 to form an expression similar in form to Equation 17.

Referring again to encoder 400, since M and $N^2$ are both non-negative and are independent of k, the following equation can be solved instead of solving Equation 33:

$$k^* = \underset{k}{\operatorname{argmax}}\left\{\frac{M}{N^2 D_k}(MA_k^2 - 2NA_k B_k + R_k N^2)\right\} \tag{34}$$

Letting $a_k=MA_k$, $b_k=NB_k$, $R'_k=MN^2R_k$, and $D'_k=N^2D_k$, Eq 34 can be rewritten as:

$$k^* = \underset{k}{\operatorname{argmax}}\left\{\frac{1}{D'_k}(a_k^2 - 2a_k b_k + R'_k)\right\} \tag{35}$$

The term $R'_k$ can be expressed in terms of $D'_k$ by observing that since $D'_k=N^2D_k=N^2MR_k-N^2B_k^2$, $R'_k=MN^2R_k$, and $b_k=NB_k$, then $R'_k=D'_k+b_k^2$. Substituting the latter expression into Equation 35 yields the following algebraic manipulation:

$$k^* = \underset{k}{\operatorname{argmax}}\left\{\frac{1}{D'_k}(a_k^2 - 2a_k b_k + D'_k + b_k^2)\right\} \tag{36a}$$

$$k^* = \underset{k}{\operatorname{argmax}}\left\{\frac{1}{D'_k}((a_k - b_k)^2 + D'_k)\right\} \tag{36b}$$

$$k^* = \underset{k}{\operatorname{argmax}}\left\{\frac{(a_k - b_k)^2}{D'_k} + 1\right\} \tag{36c}$$

Since the constant, that is, the '1,' in Equation 36c has no effect on the maximization process, the constant can be removed, with the result that Equation 36c can be rewritten as:

$$k^* = \underset{k}{\operatorname{argmax}}\left\{\frac{(a_k - b_k)^2}{D'_k}\right\}. \tag{37}$$

Next it can be shown that the parameters of the joint search can be transformed to the two precomputed parameters of the sequential FCB search of the prior art, thereby enabling use of the sequential FCB search algorithm in the joint search process performed by error minimization unit 420. The two precomputed parameters are a correlation matrix $\Phi'$ and a backward filtered target signal d'. Referring back to the sequential search-based CELP encoder 300 and Equation 17, in the sequential search performed by encoder 300 the optimal FCB excitation vector index $k^*$ is obtained from error minimization criteria as follows:

$$k^* = \underset{k}{\operatorname{argmax}}\left\{\frac{(d_2^T c_k)^2}{c_k^T \Phi c_k}\right\}, \tag{17}$$

where the right-hand side of the equation comprises the error minimization criteria and where $d_2^T=x_2^T H$, and $\Phi=H^T H$. In accordance with the embodiment depicted by encoder 400, Equation 37 can be manipulated to produce an equation that is similar in form to Equation 17. More specifically, Equation 37 can be placed in a form in which the numerator is an inner product of two vectors (one of which is independent of k), and the denominator is in a form $c_k^T\Phi' c_k$, where the correlation matrix $\Phi'$ is also independent of k.

First, the numerator in Equation 37 is compared with and analogized to the numerator in Equation 17 in order to put the denominator of Equation 37 in a form similar to the denominator of Equation 17. That is, $$d'^T c_k \Leftrightarrow a_k - b_k \tag{38}$$

$$d'^T c_k \Leftrightarrow MA_k - NB_k \tag{38a}$$

$$d'^T c_k \Leftrightarrow (c_\tau^T \Phi c_\tau) d^T c_k - (d^T c_\tau) c_\tau^T \Phi c_k \tag{38b}$$

$$d'^T c_k \Leftrightarrow (y_\tau^T y_\tau) x_w^T H c_k - (x_w^T y_\tau) y_\tau^T H c_k \tag{38c}$$

$$d'^T = ((y_\tau^T y_\tau) x_w^T - (x_w^T y_\tau) y_\tau^T) H \tag{39}$$

From Equation 39, it is apparent that if the optimal ACB gain $\gamma$, from Equation 15, for the sequential search is used, and further noting, from Equation 16, that that $d_2^T = x_2^T H = (x_w - \beta y_\tau)^T H$, one can infer that:

$$d'^T = (y_\tau^T y_\tau) d_2^T = M d_2^T. \tag{40}$$

where the term d' is a backward filtered target signal that is produced by a backward filtering of the target signal by error minimization unit 420. Equation 40 informs that the numerator of Equation 37 is merely a scaled version of the numerator in Equation 17, and more importantly, that the calculation complexity for the numerator of the joint search process performed by error minimization unit 420 of encoder 400 is, for all intents and purposes, equivalent to the calculation complexity of the numerator for the sequential search process performed by encoder 300.

Next, the denominator in Equation 37 is compared with and analogized to the denominator in Equation 17 in order to put the denominator of Equation 37 in a form similar to the denominator of Equation 17. That is, $$c_k^T \Phi' c_k \Leftrightarrow D'_k \tag{41}$$

By substituting previously defined terms, the following sequence of equivalent expressions can be derived:

$$c_k^T \Phi' c_k \Leftrightarrow N^2 M R_k - N^2 B_k^2 \tag{41a}$$

$$c_k^T \Phi' c_k \Leftrightarrow N^2 M c_k^T \Phi c_k - N^2 (c_\tau^T \Phi c_k)^2 \tag{41b}$$

Since $\Phi = H^T H$ is symmetric, then $\Phi = \Phi^T = H^T H$:

$$c_k^T \Phi' c_k \Leftrightarrow N^2 M c_k^T \Phi c_k - N^2 c_k^T \Phi c_\tau c_\tau^T \Phi c_k \tag{41c}$$

$$c_k^T \Phi' c_k \Leftrightarrow c_k^T (N^2 M \Phi - N^2 \Phi c_\tau c_\tau^T \Phi) c_k \tag{41d}$$

$$c_k^T \Phi' c_k \Leftrightarrow c_k^T (N^2 M \Phi - N^2 H^T y_\tau y_\tau^T H) c_k \tag{41e}$$

Now letting $y = H^T y_\tau$, Equation 41e can be rewritten as:

$$c_k^T \Phi' c_k \Leftrightarrow c_k^T (N^2 M \Phi - N^2 y y^T) c_k \tag{41f}$$

and the correlation matrix $\Phi'$ can be written as:

$$\Phi' = N^2 M \Phi - N^2 y y^T. \tag{42}$$

As a result, error minimization unit 420 can determine an optimal excitation vector-related index parameter k* that optimizes error minimization for the joint optimization process from the error minimization criteria (the right-hand side of the equation) based on the following equation:

$$k^* = \underset{k}{\operatorname{argmax}} \left\{ \frac{(d'^T c_k)^2}{c_k^T \Phi' c_k} \right\} \tag{43}$$

or:

$$k^* = \underset{k}{\operatorname{argmax}} \left\{ \frac{(M d_2^T c_k)^2}{c_k^T (N^2 M \Phi - N^2 y y^7) c_k} \right\} \tag{44}$$

Since the form of the error minimization criteria in Equations 17 and 44 are generally the same, the terms d' and $\Phi'$ can be pre-computed, and any existing sequential search process may be transformed to a joint search process without significant modification. Although the pre-computation steps may appear to be complex, based on the intricacy of the denominator in Equation 44, a simple analysis will show that the added complexity is actually quite low, if not trivial.

First, as discussed above, the additional complexity of the numerator in Equation 44 with respect to the numerator in Equation 17 is trivial. Given a subframe length of L=40 samples, the additional complexity is 40 multiplies per subframe. Since $M = y_\tau^T y_\tau$ already exists for the computation of the optimal $\tau$ in Equation 14, no additional computations are necessary. The same is true for the computation of $N = x_w^T y_\tau$ below.

Second, with respect to the denominator in Equation 44, the generation of $y = H^T y_\tau$ requires approximately one half of a length L linear convolution, or about 40×42/2=840 multiply-accumulate (MAC) operations. An $N^2M$ scaling of the matrix $\Phi$ can be efficiently implemented by scaling the elements of the impulse response h(n) by $\sqrt{N^2M}$ prior to generation of the matrix $\Phi = H^T H$. This requires only a square root operation and about 40 multiply operations. Similarly, a scaling of the y vector by N requires only about 40 multiply operations. Lastly, a generation and subtraction of the scaled $yy^T$ matrix from the scaled $\Phi$ matrix requires only about 840 MAC operations for a 40×40 matrix order. This is because $Y = yy^T$ is defined as a rank one matrix (i.e., Y(i,j) =y(i)y(j)) and can be efficiently generated during formation of the correlation matrix $\Phi'$ as:

$$\phi'(i, j) = \phi(i, j) - y(i)y(j),\ 0 \leqq i < L,\ 0 \leqq j \leqq i. \tag{45}$$

As is apparent to one skilled in the art from equation 45, the entire correlation matrix $\Phi'$ need not be generated at one time. In various embodiments of the invention, error minimization unit 420 may generate only one or more elements $\Phi'(i,j)$ at a given time in order to save memory (RAM) associated generating the entire correlation matrix, which one or more elements may be used in an evaluation of the error minimization criteria to determine an optimal gain parameter k, that is, k*. Furthermore, in order to generate the correlation matrix $\Phi'$, error minimization unit 420 need only generate a portion of the correlation matrix, such as an upper triangular part or a lower triangular part of the correlation matrix, because of symmetry. Thus, a total additional complexity required for a transformation of a sequential search process to a joint search process for a length 40 subframe is approximately 40+840+40+40+840=1800 multiply operations per subframe, or about 1800 multiply operations/subframe×4 subframes/frame×50 frames/second=360,000 operations/sec, for a typical implementation as found in many speech coding standards for telecommunications applications. When considering the fact that codebook search routines that can easily reach 5 to 10 million ops/sec, a corresponding penalty in complexity for the joint search process is only 3.6 to 7.2 percent. This penalty is far more efficient than the 30 to 40 percent penalty for the joint search process recommended in the Woodward and Hanzo paper of the prior art, while garnering the same performance advantage.

Thus it can be seen that encoder 400 determines analysis-by-synthesis parameters $\tau$, $\beta$, k, and $\gamma$, in a more efficient manner than the prior art encoders by optimizing excitation vector-related indices based on a correlation matrix $\Phi'$, which correlation matrix can be precomputed prior to execution of the joint optimization process. Encoder 400 generates the correlation matrix based in part on a filtered first excitation vector, which filtered first excitation vector is in turn based on an initial first excitation vector-related index parameter. Encoder 400 then evaluates error minimization criteria with respect to a determination of an optimal second excitation vector-related index parameter based on at least in part on a target signal, which is in turn based on an input signal, and the correlation matrix. Encoder 400 then generates an optimal second excitation vector-related index parameter based on the error minimization criteria. In another embodiment of the present invention, the encoder also backward filters the target signal to produce a backward filtered target signal d' and evaluates the second codebook error minimization criteria based on at least in part on the backward filtered target signal and the correlation matrix.

Now referring back to equation 44, the equation shows that if the vector y=0, then the expression for the joint search would be equivalent to the corresponding expression for the sequential search process as described in Equation 17. This is important because if there were certain sub-optimal or non-linear operations present in an analysis-by-synthesis processing, it may be beneficial to dynamically select when and when not to enable the joint search process as described herein. As a result, in another embodiment of the present invention, an analysis-by-synthesis encoder is capable of performing a hybrid joint search/sequential search process for optimization of the excitation vector-related parameters. In order to determine which search process to conduct, the analysis-by-synthesis encoder includes a selection mechanism for selecting between a performance of the sequential search process and performance of the joint search process. Preferably, the selection mechanism involves use of a joint search weighting factor $\lambda$ that facilitates a balancing, by the encoder, between the joint search and the sequential search processes. In such an embodiment, an expression for an optimal excitation vector-related index k* may be given by:

$$k^* = \underset{k}{\operatorname{argmax}}\left\{\frac{(Md_2^T c_k)^2}{c_k^T(N^2 M\Phi - \lambda N^2 yy^7)c_k}\right\} \tag{46}$$

where $0 \leqq \lambda \leqq 1$ defines the joint search weighting factor. If $\lambda=1$, the expression is the same as Equation 44. If $\lambda=0$, the impact of the constant terms (M, N) affect all codebook entries $c_k$ equivalently, so the expression produces the same results as Equation 17. Values between the extremes will produce some trade-off in performance between the sequential and joint search processes.

Figure 6:
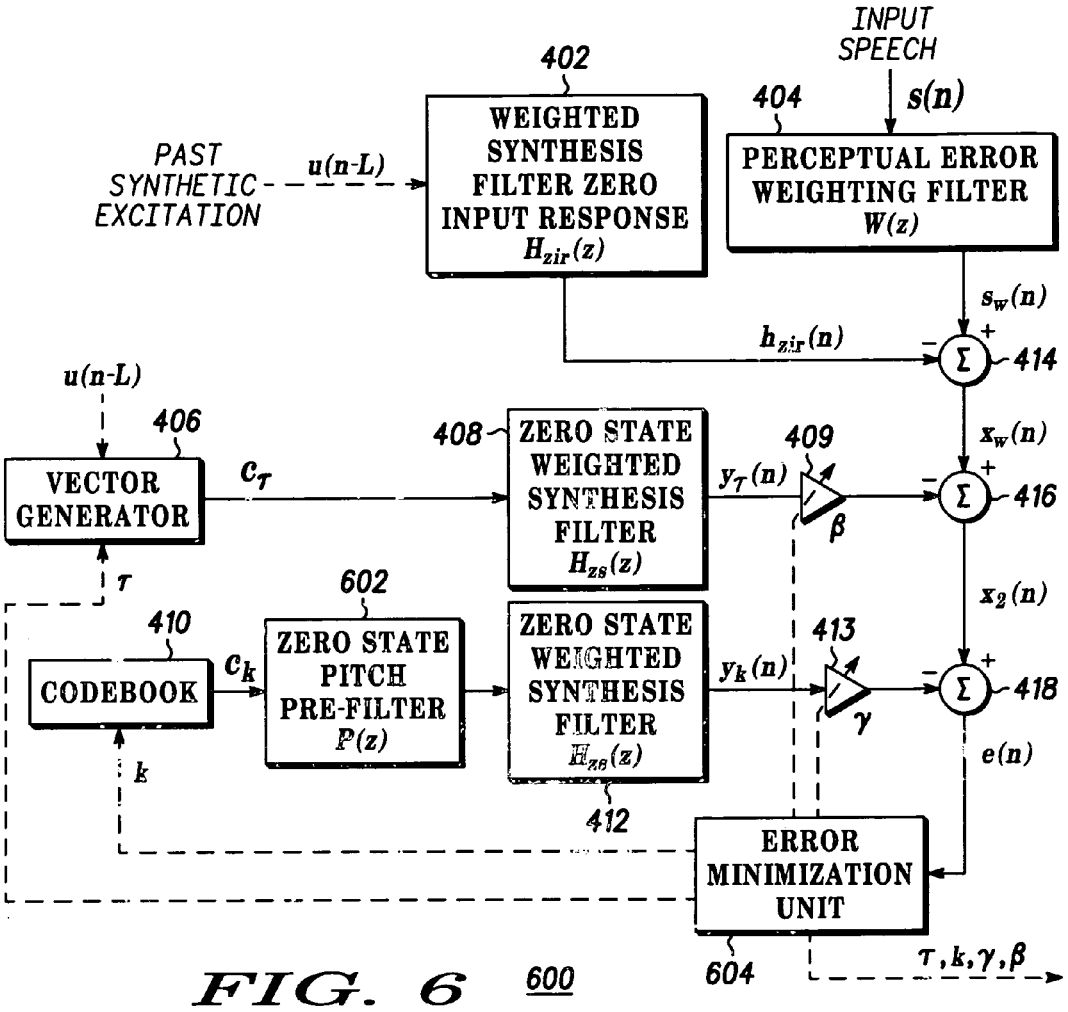
FIG. 6 is a block diagram of a CELP encoder in accordance with another embodiment of the present invention.
Figure 7:
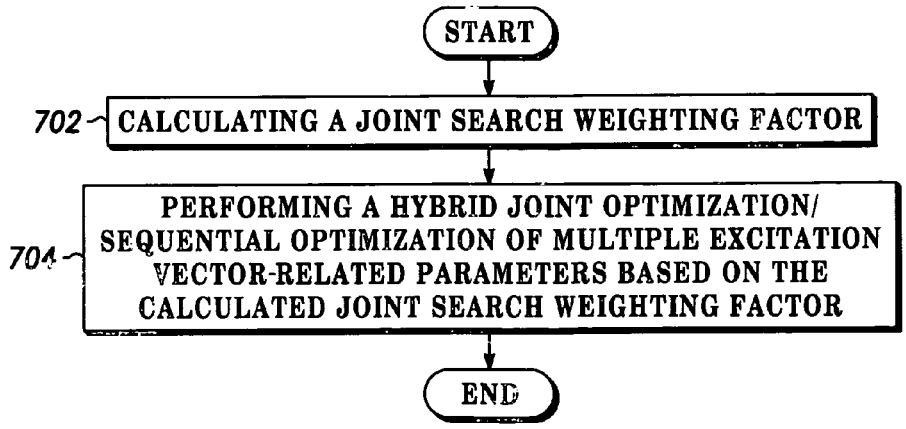
FIG. 7 is a logic flow diagram of steps executed by a CELP encoder in determining whether to perform a joint search process or a sequential search process in accordance with another embodiment of the present invention.

Referring now to FIGS. 6 and 7, an analysis-by-synthesis encoder is illustrated that is capable of performing a both a joint search process and a sequential search process. FIG. 6 is a block diagram 600 of an exemplary CELP encoder 600 that is capable of performing a both a joint search process and a sequential search process in accordance with another embodiment of the present invention. FIG. 7 is a logic flow diagram 700 of the steps executed by encoder 600 in determining whether to perform a joint search process or a sequential search process. Encoder 600 utilizes a joint search weighting factor $\lambda$ that permits encoder 600 to determine whether to perform a joint search process or a sequential search process. Encoder 600 is generally similar to encoder 400 except that encoder 600 includes a zero-state pitch pre-filter 602 that filters the excitation vector $c_k$ generated by second codebook 410 and further includes an error minimization unit, that is, a squared error minimization/parameter block, that calculates a joint search weighting factor $\lambda$ and determines whether to perform a joint search process or a sequential search process based on the calculated joint search weighting factor. Pitch pre-filters are well known in the art and will not be described in detail herein. For example, exemplary pitch pre-filters are described in ITU-T (International Telecommunication Union-Telecommunication Standardization Section) Recommendation G.729, available from ITU, Place des Nations, CH-1211 Geneva 20, Switzerland, and in U.S. Pat. No. 5,664,055, entitled "CS-ACELP Speech Compression System with Adaptive Pitch Prediction Filter Gain Based on a Measure of Periodicity."

A zero-state pitch pre-filter transfer function may be represented as:

$$P(z) = \frac{1}{1 - \beta' z^{-\tau}} \tag{47}$$

where $\beta'$ is a function of the optimal excitation vector-related parameter gain $\beta$, that is, $\beta'=f(\beta)$. For ease of implementation and minimal complexity during the codebook search process, pitch pre-filter 602 is convolved with a weighted synthesis filter impulse response h(n) of a weighted synthesis filter 412 of encoder 600 prior to the search process. Such methods of convolution are well known. However, since an optimal value for excitation vector-related gain $\beta$ for the joint search has yet to be determined, the prior art joint search (and also the sequential search process described in ITU-T Recommendation G.729) uses a function of a quantized excitation vector-related gain from a previous subframe as the pitch pre-filter gain, that is, $\beta'(m)=f(\beta_q(m-1))$, where m represents a current subframe, and m−1 represents a previous subframe. The use of a quantized gain is important since the quantity must also be made available to the decoder. The use of a parameter based on the previous subframe for the current subframe, however, is sub-optimal since the properties of the signal to be coded are likely to change over time.

Referring now to FIG. 7, a CELP encoder such as encoder 600 determines whether to perform a joint search process or a sequential search process for a coding of a subframe by calculating (702), by an error minimization unit 604, preferably a squared error minimization/parameter block, of encoder 600, a joint search weighting factor $\lambda$ and performing (704), by the squared error minimization/parameter block and based on the joint search weighting factor, a hybrid joint search/sequential search process, that is, with reference to equation 46, jointly optimizing or sequentially optimizing at least two of a first excitation vector and an associated first excitation vector-related gain parameter, and a second excitation vector and an associated second excitation vector-related gain parameter, or performing an optimization process that is somewhere between the two processes.

Referring again to FIG. 6, in one embodiment of the present invention, in the optimization process performed by error minimization unit 604 of encoder 600, it is desirable to place more emphasis on the periodicity of the current frame. This is accomplished by tuning the joint search weighting factor $\lambda$ towards a lesser amount when the pitch period of the current subframe is less than the subframe length and the unquantized excitation vector-related gain $\beta$ is high. This can be described by the expression:

$$\lambda = \begin{cases} 1, & \tau \geq L \\ 0 \leq f(\beta) \leq 1, & \tau < L \end{cases} \tag{48}$$

where $f(\beta)$ has been empirically determined to have good properties when $f(\beta)=1-\beta^2$, although a variety of other functions are possible. This has the effect of placing more emphasis on using a sequential search process for highly periodic signals in which the pitch period is less than a subframe length, whereby the degree of periodicity has been determined during the adaptive codebook search as represented by Equations 13 and 14. Thus, when the periodicity of the current frame is emphasized in the determination of the joint search weighting factor, encoder 600 tends toward a joint optimization process when the periodicity effect ($\beta$) is low and tends toward a sequential optimization process when the periodicity effect is high. As an example, when the lag $\tau$ is less than the subframe length L, and the degree of periodicity is relatively low ($\beta$=0.4), then the value of the joint search weighting factor is $\lambda=1-(0.4)^2=0.86$, which represents an 86% weighting toward the joint search.

In still another embodiment of the present invention, error minimization unit 604 of encoder 600 may make the factor $\lambda$ a function of both the unquantized excitation vector-related gain $\beta$ and the pitch delay. This can be described by expression:

$$\lambda = \begin{cases} 1, & \tau \geq L \\ 0 \leq f(\beta, \tau) \leq 1, & \tau < L. \end{cases} \tag{49}$$

The periodicity effect is more pronounced when the delay is towards a lower value and the unquantized excitation vector-related gain $\beta$ is towards a higher value. Thus, it is desired that the factor $\lambda$ be low when either the excitation vector-related gain $\beta$ is high or the pitch delay is low. The following function:

$$f(\beta, \tau) = \begin{cases} 1.0, & \beta\left(1 - \frac{\tau}{L}\right) < 0.2 \\ 1 - 0.18\beta\left(1 - \frac{\tau}{L}\right), & \text{otherwise} \end{cases} \tag{50}$$

has been empirically found to produce desired results. Thus, when the unquantized ACB gain and the pitch delay are emphasized in the determination of the joint search weighting factor, encoder 600 tends toward a joint optimization process, otherwise the determination of the joint search weighting factor tends toward a sequential optimization process. As an example, when the lag $\tau$=30 and is less than the subframe length L=40, and the degree of periodicity is relatively low ($\beta$=0.4), then the value of the joint search weighting factor is $\lambda=1-0.18\times0.4\times(1-30/40)=0.98$, which represents a 98% weighting toward the joint search.

In summary, a CELP encoder is provided that optimizes excitation vector-related parameters in a more efficient manner than the encoders of the prior art. In one embodiment of the present invention, a CELP encoder optimizes excitation vector-related indices based on the computed correlation matrix, which matrix is in turn based on a filtered first excitation vector. The encoder then evaluates error minimization criteria based on at least in part on a target signal, which target signal is based on an input signal, and the correlation matrix and generates a excitation vector-related index parameter in response to the error minimization criteria. In another embodiment of the present invention, the encoder also backward filters the target signal to produce a backward filtered target signal and evaluates the second codebook. In still another embodiment of the present invention, a CELP encoder is provided that is capable of jointly optimizing and/or sequentially optimizing codebook indices by reference to a joint search weighting factor, thereby invoking an optimal error minimization process.

While the present invention has been particularly shown and described with reference to particular embodiments thereof, it will be understood by those skilled in the art that various changes may be made and equivalents substituted for elements thereof without departing from the scope of the invention as set forth in the claims below. Accordingly, the specification and figures are to be regarded in an illustrative rather then a restrictive sense, and all such changes and substitutions are intended to be included within the scope of the present invention.

Benefits, other advantages, and solutions to problems have been described above with regard to specific embodiments. However, the benefits, advantages, solutions to problems, and any element(s) that may cause any benefit, advantage, or solution to occur or become more pronounced are not to be construed as a critical, required, or essential feature or element of any or all the claims. As used herein, the terms "comprises," "comprising," or any variation thereof, are intended to cover a non-exclusive inclusion, such that a process, method, article, or apparatus that comprises a list of elements does not include only those elements but may include other elements not expressly listed or inherent to such process, method, article, or apparatus. It is further understood that the use of relational terms, if any, such as first and second, top and bottom, and the like are used solely to distinguish one from another entity or action without necessarily requiring or implying any actual such relationship or order between such entities or actions.

What is claimed is:

1. A method for generating jointly optimized vector-related parameters in an analysis-by-synthesis coding system comprising steps of:

receiving an input signal;

generating a target vector based on the input signal;

generating one or more elements of a first correlation matrix based on a synthesis filter;

generating one or more elements of a correlation modification matrix based on a first excitation vector;

summing the elements of the first correlation matrix with the elements of the correlation modification matrix to produce one or more elements of a second correlation matrix;

evaluating an error minimization criteria based in part on the target vector and the one or more elements of the second correlation matrix;

generating a parameter associated with a second excitation vector based on the error minimization criteria; and conveying the parameter to at least one of a storage medium and a decoder for use to construct an estimate of the input signal.

2. The method of claim 1, further comprising a step of filtering the target signal in a backward manner to produce a backward filtered target signal and wherein the step of evaluating an error minimization criteria comprises a step of evaluating an error minimization criteria based in part on the backward filtered target signal and the one or more elements of the second correlation matrix.

3. The method of claim 1, wherein the step of generating a parameter associated with a second excitation vector based on the error minimization criteria comprises steps of:

generating an excitation vector-related index parameter based on the error minimization criteria; and generating a second excitation vector based on the excitation vector-related index parameter.

4. The method of claim 1, wherein the step of generating a parameter associated with a second excitation vector in response to the error minimization criteria comprises steps of:

generating the second excitation vector based on the error minimization criteria; and generating an excitation vector-related index parameters based on the second excitation vector.

5. The method of claim 1, further comprising a step of filtering the first excitation vector to produce a filtered first excitation vector and wherein the step of generating one or more elements of a correlation modification matrix comprises a step of generating one or more elements of a correlation modification matrix based in part on the filtered first excitation vector.

6. The method of claim 5, further comprising a step of weighting the filtered first excitation vector to produce a weighted, filtered first excitation vector and wherein the step of generating one or more elements of a correlation modification matrix comprises a step of generating one or more elements of a correlation modification matrix based on the target vector and the weighted, filtered first excitation vector.

7. The method of claim 1, wherein the first excitation vector comprises a first adaptive codebook (ACB) code-vector and wherein the step of generating a parameter associated with a second excitation vector comprises a step of generating an ACB gain parameter based on the error minimization criteria.

8. The method of claim 1, wherein the second excitation vector comprises a fixed codebook (FCB) code-vector and wherein the step of generating a parameter associated with a second excitation vector comprises steps of:

generating an FCB index parameter and an FCB gain parameter based on the error minimization criteria; and generating the FCB code-vector based on the FCB index parameter.

9. The method of claim 1, wherein the step of summing the elements of the first correlation matrix with the elements of the correlation modification matrix to produce one or more elements of a second correlation matrix further comprises steps of:

calculating a joint search weighting factor; and based on the calculated joint search weighting factor, forming a weighted sum of the elements of the first correlation matrix with the elements of the correlation modification matrix to produce one or more elements of a second correlation matrix.

10. The method of claim 9, wherein the step of calculating a joint search weighting factor comprises steps of determining a length of a subframe and determining a pitch period of the subframe and wherein the method further comprises steps of:

comparing the determined length of the subframe to the determined pitch period of the subframe to produce a comparison; and calculating the joint search weighting factor based on the comparison.

11. The method of claim 9, wherein the step of calculating a joint search weighting factor comprises steps of determining a gain associated with a previous subframe, and wherein the method further comprises calculating a joint search weighting factor in response to determining a gain associated with a previous subframe.

12. The method of claim 1, wherein the vector-related parameters comprises an adaptive codebook gain parameter, a fixed codebook index parameter, and a fixed codebook gain parameter.

13. The method of claim 1, wherein the second excitation vector comprises a fixed codebook (FCB) code-vector and wherein the step of generating a parameter associated with a second excitation vector comprises steps of:

generating an FCB code-vector and an FCB gain parameter based on the error minimization criteria; and generating an FCB index parameter based on the FCB code-vector.

14. An analysis-by-synthesis coding apparatus comprising:

means for receiving an input signal;

means for generating a target vector based on the input signal; and an error minimization unit that generates one or more elements of a first correlation matrix based on a synthesis filter, generates one or more elements of a correlation modification matrix based on a first excitation vector, sums the elements of the first correlation matrix with the elements of the correlation modification matrix to produce one or more elements of a second correlation matrix, evaluates error minimization criteria based at least in part on the one or more elements of the second correlation matrix and the target vector, generates a parameter associated with a second excitation vector based on the error minimization criteria, and conveys the parameter to at least one of a storage medium and a decoder for use to construct an estimate of the input signal.

15. The apparatus of claim 14, further comprising a vector generator that generates the second excitation vector based on the parameter.

16. The apparatus of claim 15, wherein the error minimization unit generates a plurality of parameters based on the error minimization criteria, wherein the vector generator generates the second vector generator excitation vector based on a first parameter of the plurality of parameters and wherein the apparatus further comprises a codebook that generates a codebook code-vector based on a second parameter of the plurality of parameters.

17. The apparatus of claim 16, wherein the vector generator comprises an adaptive codebook and the codebook comprises a fixed codebook.

18. The apparatus of claim 14, further comprising a codebook that generates the second excitation vector based on the parameter.

19. The apparatus of claim 14, wherein the error minimization unit further filters the target vector in a backward maimer to produce a backward filtered target signal and wherein the error minimization unit evaluates error minimization criteria based in part on the one or more elements of the second correlation matrix and the backward filtered target signal.

20. The apparatus of claim 14, further comprising a weighted synthesis filter that filters the first excitation vector to produce a filtered first excitation vector and wherein the error minimization unit generates one or more elements of the correlation modification matrix based in part on the filtered first excitation vector.

21. The apparatus of claim 20, further comprising a weighter that applies a gain to the filtered first excitation vector to produce a weighted, filtered first excitation vector and wherein the error minimization unit generates one or more elements of a correlation modification matrix based on the target vector and the weighted, filtered first excitation vector.

22. The apparatus of claim 14, wherein the error minimization unit generates a plurality of parameters based on the error minimization criteria and further generates a second excitation vector-related gain parameter based on the error minimization criteria.

23. The apparatus of claim 14, wherein the vector generator comprises an adaptive codebook (ACB) and the first excitation vector comprises a first adaptive codebook (ACB) code-vector, wherein the error minimization unit generates art ACB gain parameter based on the error minimization criteria.

24. The apparatus of claim 14, wherein the apparatus further comprises a fixed codebook (FCB), wherein the second excitation vector comprises an fixed codebook code-vector, wherein the error minimization unit generates an FCB index parameter and an FCB gain parameter based on the error minimization criteria, and wherein the first codebook generates the fixed codebook code-vector based on the FCB index parameter.

25. An encoder for analysis-by-synthesis coding of a subframe, the encoder comprising a processor that calculates a joint search weighting factor by determining a length of the subframe and determining a pitch period of the subframe, compares the determined length of the subframe to the determined pitch period of the subframe to produce a comparison, in response to the comparison, performs an optimization process that is a hybrid of a joint optimization of at least two parameters of a plurality of excitation vector-related parameters and a sequential optimization of the at least two parameters of the plurality of excitation vector-related parameters, and wherein the encoder conveys the at least two parameters to at least one of a storage medium and a decoder for use to construct an estimate of a signal input to the encoder.

26. The encoder of claim 25, wherein the plurality of excitation vector-related parameters comprises an adaptive codebook gain parameter, a fixed codebook index parameter, and a fixed codebook gain parameter.

27. An encoder for analysis-by-synthesis coding of a current subframe, the encoder comprising:

a processor that calculates a joint search weighting factor by determining a gain associated with a previous subframe, and performing a hybrid optimization process in response to the determined gain of the previous subframe, wherein the hybrid optimization process is a hybrid of a joint optimization of at least two parameters of a plurality of excitation vector-related parameters and a sequential optimization of the at least two parameters of the plurality of excitation vector-related parameters, and wherein the encoder conveys the at least two parameters to at least one of a storage medium and a decoder for use to construct an estimate of a signal input to the encoder.

28. The encoder of claim 27, wherein the plurality of excitation vector-related parameters comprises an adaptive codebook gain parameter, a fixed codebook index parameter, and a fixed codebook gain parameter.

* * * * *